United States Patent [19]

Jenkner

[11] Patent Number: 4,688,614

[45] Date of Patent: Aug. 25, 1987

[54] PROCESS FOR TRIMMING AND SPLITTING UP BOARDS HAVING UNFINISHED EDGES, SUCH AS EDGES STILL COVERED WITH BARK, AND APPARATUS FOR PERFORMING THE PROCESS

[76] Inventor: Detlef Jenkner, Schwarzwaldstr. 68, Herrenberg, Fed. Rep. of Germany, D-7033

[21] Appl. No.: 731,309

[22] Filed: May 7, 1985

[30] Foreign Application Priority Data

May 23, 1984 [DE] Fed. Rep. of Germany ..... 3419212

[51] Int. Cl.[4] ..... B27B 1/00

[52] U.S. Cl. ..... 144/378; 83/435.1; 144/377

[58] Field of Search ..... 83/707, 435.1; 144/376, 144/378, 377

[56] References Cited

U.S. PATENT DOCUMENTS 3,963,938 6/1976 Sanglert ..... 144/378
4,240,477 12/1980 Horn et al. ..... 144/378
4,250,937 2/1981 Detjen ..... 83/435.1
4,316,491 2/1982 Kearnes et al. ..... 83/435.1
4,468,992 9/1984 McGeehee ..... 144/378

*Primary Examiner*—W. D. Bray
*Attorney, Agent, or Firm*—Dick and Harris

[57] ABSTRACT

A process which enables boards with unfinished edges or edges still covered with bark to be split up easily and rapidly is suggested.

After clamping for performance of the trimming cut, the board is gripped at its unfinished edge located opposite to the unfinished edge to be severed, and is prevented from displacement in the longitudinal direction and from pivoting in its bearing plane. For performance of consecutive separating cuts, the board is then displaced in the transverse direction in such a way that the remaining unfinished edge approaches the cutting plane.

The advantage of this process is that boards need only be trimmed on one longitudinal side, and the separating cuts may be made subsequently, with the other unfinished edge being left over at the end as remainder.

7 Claims, 1 Drawing Figure

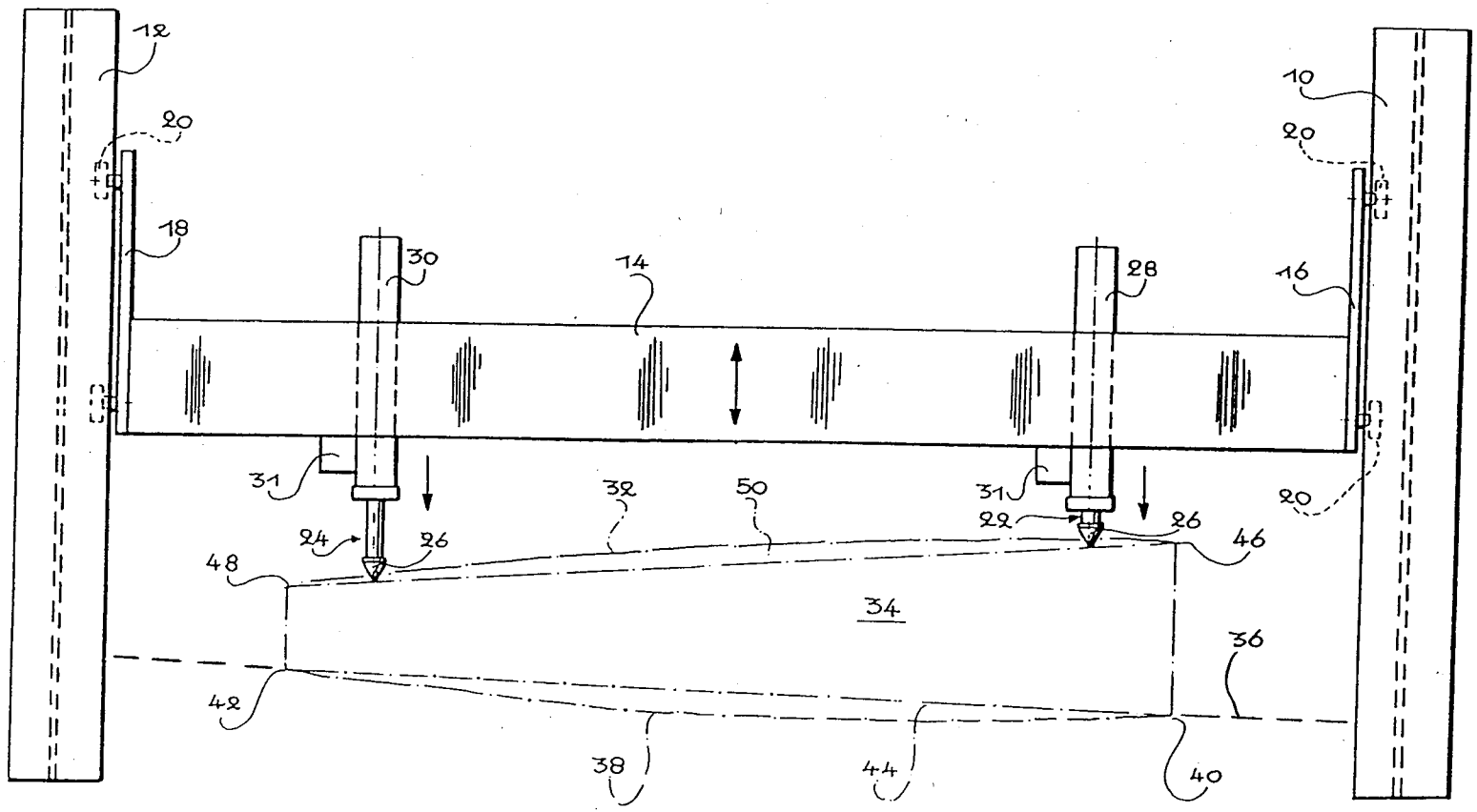
10
20
16
20
28
46
26
36
40
31
22
34
44
50
74
32
38
30
26
24
31
48
42
12
20
18

PROCESS FOR TRIMMING AND SPLITTING UP BOARDS HAVING UNFINISHED EDGES, SUCH AS EDGES STILL COVERED WITH BARK, AND APPARATUS FOR PERFORMING THE PROCESS

The invention relates to a process for trimming and splitting up boards having unfinished edges, such as edges still covered with bark, wherein one unfinished edge of a board is aligned relative to a cutting plane and, after clamping of the board, is severed from it, wherein the board is, furthermore, aligned with respect to the position of the edge which has been trimmed relative to the cutting plane in such a way that subsequent transverse displacement of the board causes the trimmed edge to be displaced parallel to the cutting plane, and wherein, after clamping and completion of a first separating cut, the board is each time displaced in the same direction, then clamped, and, finally, severed, in order to be split up into single strips or sections of square timber.

According to a known process of this kind, unfinished boards produced from tree trunks are trimmed and split up in the following manner:

One unfinished edge (edge still covered with bark) of the unfinished boards is first aligned into the cutting plane of an apparatus for trimming and splitting up panels and clamped in such a way that the one unfinished edge is first severed from the board, with the result that the unfinished board is trimmed along one longitudinal side. The initial cutting waste formed by the unfinished edge is then removed from the apparatus. The board is subsequently pushed with its trimmed edge against a stop of a feed device, so that the trimmed edge forms the basis of alignment for the separating cuts. The board is then displaced in the opposite direction with the aid of the feed device until the other unfinished edge is adjusted relative to the cutting plane so as to obtain after completion of a further trimming cut, a board with parallel trimmed or longitudinal edges.

This process is tedious since both unfinished edges first must be removed from the board, and on account of the trimming on both sides, a trimmed remainder which is too narrow to be made use of its often unavoidably left over from the splitting up procedure.

The object underlying the invention is therefore to suggest a process of the kind explained at the outset, which requires only one trimming cut for splitting up boards with unfinished edges, which is, furthermore, simpler to perform, and with which a trimmed remainder is prevented from being left over.

This object is attained in accordance with the invention in that after the clamping for performance of the trimming cut, the board is gripped at its unfinished edge located opposite to the unfinished edge to be severed and is prevented from displacement in the longitudinal direction and from pivoting in its bearing plane, and in that in order to perform consecutive separating cuts, the board is displaced in the transverse direction in such a way that the remaining unfinished edge approaches the cutting plane.

With this process, it is unnecessary to align the board against a stop means after removal of one unfinished edge; on the contrary, an operation adequate for alignment already takes place during clamping of the board for performance of the trimming cut, so that after severing of the unfinished edge, the board may be displaced in the transverse direction, for splitting up into single strips or sections of squared timber, through paths corresponding to the desired width of such sections, to enable performance of corresponding separating cuts. At the end, the other unfinished edge is then left over as remainder. A remainder trimmed at both sides of insufficient width therefore no longer occurs.

Suitable for performance of the process according to the invention is an apparatus which is characterized by a carrier adjustable in the feed direction, on which there are provided in a common plane two mutually spaced supporting members which may be brought to rest against an unfinished edge of boards to be split up, and which are arranged on the carrier so as to be adjustable and retainable in both the transverse and feed directions.

In order to feed the board, the two supporting members on the carrier are positioned such that, in the proximity of the end faces of a board to be split up, they support the unfinished edge which has remained on it, in such a way that the board is also incapable of displacement in the longitudinal direction. This is advantageously achievable with supporting members which may be brought to rest with one pointed cone each against the unfinished edge of a board. In this case, the cone points dig into the unfinished edge and thus effect the necessary securing of the board in its position during the feeding of the board for performance of the individual separating cuts.

It is expedient for the supporting members to be automatically retainable on the carrier after extension and contact with the unfinished edge when the carrier has been fixed in the feed direction. In this way, the board may be automatically supported after it has been adjusted and fixed relative to the cutting plane for performance of the trimming cut.

It is, furthermore, advantageous for the adjustment paths of the carrier for performance of separating cuts, to be preselectable and automatically realizable in timed sequence with an apparatus for trimming and splitting up panels connected in series with the carrier.

The drawing is a schematic illustration and top view of an apparatus for performing the process.

The apparatus comprises a carrier 14 which is arranged for horizontal displacement between two guide rails 10 and 12 and carries, for example, at each of its end faces one roller bar 16 and 18, respectively, whose rollers 20 are guided in a rollable manner in suitable guides of the guide rails 10 and 12.

Two supporting members 22 and 24 are provided on the carrier 14. The supporting members on the carrier 14 which are adjustable and retainable in both its longitudinal direction and its direction of adjustment are each formed, for example, by one piston rod of a cylinder piston unit 28 and 30, respectively, with a pointed cone 26 provided on each piston rod. The cylinder piston units are double-acting and preferably pneumatically actuatable. Associated with each cylinder is a retaining device designated by 31 with whose aid the piston rod may be retained automatically once the pertinent pointed cone 26 is brought to rest with a certain pressure against an unfinished edge 32 (edge still covered with bark) of board 34 which is to be split up.

Reference numeral 36 designates a cutting plane of an apparatus for trimming and splitting up panels extending parallel to the longitudinal axis of the carrier 14. The cutting plane is indicated by a dot-and-dash line.

The process according to the invention is performed as follows:

A board cut from a tree trunk with two unfinished edges 32 and 38 is placed on the workpiece table of the apparatus in such a way that its longitudinal direction extends in the direction of the cutting plane 36. In this position, the unfinished edge 32, for example, faces the pointed cones 26 of the supporting members 22 and 24.

The board 34 is first trimmed by severing the other unfinished edge 38 along a longitudinal side. For this purpose, it is positioned in such a way that the initial points 40 and 42 of the unfinished or bark covered edge 38 at the end faces lie in the cutting plane 36.

The board 34 is then clamped and the corresponding trimming cut is made. The cutting means in the preferred embodiment comprise a standard circular saw blade or the like, which serves to define the cutting plane along its cutting edge. The resulting trimmed edge is indicated in a dot-and-dash line and is designated by 44 clamping of board 34 is achieved in the preferred embodiment through the use of a conventional clamping means so as to produce the requisite contact force for clamping the board 34 against the bearing plane defined by the top surface of the workpiece table.

While the board 34 is fixed on the workpiece supporting surface of the trimming and splitting up apparatus, the two supporting members 22 and 24 are driven pneumatically in the direction of the unfinished or bark covered edge 32 and brought to rest under pressure against it in each of the end areas of the board 34. The points of the pointed cone 26 dig into this edge, whereby the board 34 is prevented from displacement in its longitudinal direction and from pivoting in its bearing plane. Pointed cones 26 extend and penetrate the board edge 32 so as to grip the board 34, until the contact pressure in the cylinder units 28 and 30, due to the penetration resistance encountered from the board edge 32, reaches a predetermined magnitude and are thereafter maintained in such an extended position until retraction thereof is desired. No holding means located opposite the pointed cones 26 are required for clamping or gripping of the board 34 and thereby preventing undesired movement of the board 34. The pointed cones 26 which dig into the one unfinished edge 32 of the board 34, together with the clamping means, prevent the board 34 from either moving along its longitudinal direction, or from rotating on the supporting table surface. Indeed, the pointed cones 26 can only penetrate the board edge 32 when the board 34 has first been clamped on the supporting table surface by the clamping means.

Once a predetermined contact pressure is reached, the supporting members 22 and 24 are automatically blocked relative to the carrier 14, with the result that the board is supported in a stable position on its unfinished or bark covered edge 32 at two points spaced at a relatively large distance from one another. This "automatic blocking" is achieved in the following manner. Supporting members 22 and 24 are pressed by the cylinders 28 and 30 against the unfinished edge 32 of the board 34 clamped on the table by conventional clamping means and the pointed cones 26 of the supporting members penetrate the unfinished edge 32. Once the penetration resistance exerted by the board 34 during penetration by members 22 and 24, the pistons of cylinders 28 and 30 are brought to a standstill by the locking devices 31 associated with the cylinders. The pressing force from supporting members 22 and 24 then ceases to be exerted, and when the board is released by the clamping means for advance, it can neither turn in its bearing plane about a vertical axis nor move in its longitudinal direction relative to supporting members 22 and 24. Accordingly, board 34 maintains a defined and constant position relative to the supporting members 22 and 24 during the advance motions.

To cut off the unfinished edge 38 during the first cut, the board 34 is first oriented on the workpiece table so that the initial points 40 and 42 lie in the cutting plane 36. The board 34 is then clamped to the table by whatever clamping means desired, so as to maintain its position relative to the cutting plane 36, and place board 34 under tension.

When the trimmed edge 44 has been produced and the unfinished or bark covered edge 38 removed, the tension to which the board 34 is subjected may be released, by releasing the conventional clamping means so that board 34 can then be adjusted in the direction of advance by the carrier 14 and the supporting members 22 and 24, and reset in relation to the cutting plane 36 for a severing cut to be made, after again clamping it relative to the table. When unfinished edge 38 has been cut off, i.e. when the trimmed edge 44 has been made by the first cut, and the supporting members 22 and 24 are brought into engagement with the unfinished edge 32, the clamping means can be raised or removed from the board, so that the board can be moved into position for the next cut, by carrier 14 including supporting members 22 and 24.

After completion of the last separating cut, which ideally ends in the end points 46 and 48 at the end faces of the unfinished or bark covered edge 32, a remainder 50 which is only still untrimmed along one longitudinal side is left over.

The supporting members 22 and 24 are capable of travelling through a maximum adjustment path which is so designed that even if the contour of the unfinished or bark covered edge 32 is extremely convex, the board can be safely supported.

At the start of the processing of unfinished boards, the carrier 14 is positioned at such a distance from the cutting plane 36 that the supporting members 22 and 24 then only need to be extended in the direction of the unfinished or bark covered edge 32 in order to support the unfinished boards as explained above. After completion of the trimming cut, the carrier is then adjusted in the feed direction through such paths as correspond to the desired width of the strips or sections of squared timber to be produced by separating cuts.

When a board has been used up, the carrier 14 and the supporting members 22 and 24 are returned to their rear initial position. Once a new unfinished board 34 is placed on the apparatus and its front unfinished or bark covered edge 38 aligned relative to the cutting plane 36, the above-described work cycle is initiated anew.

What is claimed is:

1. A process for trimming and splitting up boards having at least one unfinished edge, such as edges still covered with bark, positioned upon table means and restrainable by conventional releasable clamping means, into one or more strips of squared lumber while minimizing the amount of any unuseable portion of said board remaining, by cutting means defining a cutting plane, wherein said process comprises the steps of:

positioning said unfinished board upon said table means so that longitudinal axis of said unfinished board is aligned substantially parallel to said cutting plane;

advancing said unfinished board by carrier means, along a transverse direction towards said cutting plane, so as to align a first unfinished edge of said board for trimming by said cutting means;

immobilizing said unfinished board through said conventional releasable clamping means;

gripping said unfinished board by gripping means so as to prevent undesired rotation or translation of said unfinished board upon said table means;

feeding said unfinished board towards said cutting means by said carrier means along a feed direction;

cutting said unfinished board by said cutting means so as to trim away said first unfinished edge from said unfinished board;

releasing the remainder of said unfinished board by releasing said releasable clamping means;

advancing said unfinished board by said carrier means towards said cutting plane along said transverse direction so as to align said board for additional cuts of said board into said one or more strips of squared lumber;

refeeding said unfinished board towards said cutting means by said carrier means along said feed direction;

reclamping said unfinished board so as to again immobilize said board by said conventional releasable clamping means; and cutting said unfinished board by said cutting means, so as to trim away at least one additional subsequent unfinished edge from the remainder of said unfinished board.

2. The invention as recited in claim 1, comprising the additional step of realigning said remainder of said unfinished board with respect to said cutting plane prior to reclamping thereof and trimming away of said second unfinished edge therefrom.

3. The apparatus as recited in claim 1 wherein said carrier means further comprises said carrier means being selectably adjustable and restrainable along said feed direction, substantially perpendicular to said cutting plane, and along said transverse direction, substantially perpendicular to said feed direction.

4. The apparatus as recited in claim 1 wherein said gripping means comprises:

two or more mutually spaced supporting members operably associated with said carrier means;

said supporting members being adjustable and retainable in both said feed and transverse directions; and each of said supporting members having a first extendable end for contacting said second unfinished edge of said unfinished board positioned upon said table means.

5. The apparatus as recited in claim 4 wherein said supporting members further comprise:

a substantially pointed cone member affixed to each of said supporting members proximate said first extendable ends thereof; and said cone members serving to contact and bear against said second unfinished edge of said unfinished board under pressure so as to engage and grip said unfinished board, when said supporting members are in an extended position.

6. The apparatus as recited in claim 5 wherein said supporting members are automatically retainable in said extended position so as to maintain said contact with said second unfinished edge of said unfinished board, while said carrier means is moved along said feed direction.

7. The apparatus as recited in claim 1 wherein said carrier means is operably associated with control means so as to enable preselection and automatic timed sequencing with said cutting means.

* * * * *

UNITED STATES PATENT AND TRADEMARK OFFICE

CERTIFICATE OF CORRECTION

PATENT NO. : 4,688,614

DATED : August 25, 1987

INVENTOR(S) : Jenkner, Detlef

It is certified that error appears in the above-identified patent and that said Letters Patent is hereby corrected as shown below:

| | |
|---|---|
| Col. 2, Line 62 | before "board" insert -- a -- |
| Col. 4, Line 64 | before "longitudinal" insert -- the -- |

Signed and Sealed this

Ninth Day of May, 1989

*Attest:*

DONALD J. QUIGG

*Attesting Officer*

*Commissioner of Patents and Trademarks*